US006786849B1

(12) United States Patent
Faulconer

(10) Patent No.: US 6,786,849 B1
(45) Date of Patent: Sep. 7, 2004

(54) ADJUSTABLE HAND GRIP EXERCISER

(75) Inventor: Mark Faulconer, Newport Beach, CA (US)

(73) Assignee: McCrane, Inc., Napa, CA (US)

( * ) Notice: Subject to any disclaimer, the term of this patent is extended or adjusted under 35 U.S.C. 154(b) by 0 days.

(21) Appl. No.: 10/429,146

(22) Filed: Apr. 28, 2003

(51) Int. Cl.[7] ..... A63B 23/14; A63B 23/16

(52) U.S. Cl. ..... 482/44; 482/49; 482/907; 482/121; 482/122

(58) Field of Search ..... 482/907, 49, 121, 482/122–30, 44–50; D21/684

(56) References Cited

U.S. PATENT DOCUMENTS 632,114 A 8/1899 Hendrickson
5,246,413 A * 9/1993 Koblick ..... 482/126
5,599,256 A 2/1997 Hughes
6,007,460 A 12/1999 Young
D418,561 S 1/2000 Cousins

* cited by examiner

*Primary Examiner*—Nicholas D. Lucchesi
*Assistant Examiner*—L Amerson
(74) *Attorney, Agent, or Firm*—Richard E. Backus

(57) ABSTRACT

A hand grip for use in the self-exercise of hand, wrist and forearm muscles. A pair of pivot elements are mounted about a common pin for pivotal back and forth movement so that the head ends of the elements move together and apart. A force resistance elastomeric member having an interior cavity is releasably mounted on the head ends. Forces applied by the user in repetitively squeezing handles together cause the head ends to move apart against the yieldable resistance of the member. The member's elastic memory causes the elements to pivot back as the user releases his or her grip. A slot in the elastomeric member through which the head ends are mounted enables easy interchange between members of different elastic strengths to provide for a wide range of force resistances.

5 Claims, 2 Drawing Sheets

ADJUSTABLE HAND GRIP EXERCISER

BACKGROUND OF THE INVENTION

1. Field of the Invention

This invention relates in general to hand grips for use in the self-exercise of the hand, wrist and forearm muscles.

2. Description of the Related Art

Heretofore, various types of hand grip exercisers have been developed to strengthen and tone muscles in the hand, wrist and forearm. Certain of the prior grips of this type have employed yieldable resistance elements such as metal springs or elastic bands coupled with handles which the user repetitively squeezes together. These prior grips provide a set degree of resistance to the gripping force applied by the user. A grip which has a resistance which is comfortable to one user may not be suitable to another. Furthermore, after an individual may exercise with a particular grip for a period of weeks or months, a certain level of muscle toning and conditioning is reached such that the individual finds it desirable go to the next level of force resistance. With the prior art devices this means that the hand grip must be set aside and replaced with one that has a stronger spring or elastic band.

Certain prior art hand grips have mechanical adjusting devices for adjusting the spring resisting forces. However, these devices are relatively complicated and expensive to manufacture. While in certain prior art grips with elastic bands it is possible to replace the bands, the procedure is cumbersome and time consuming. It would be desirable to provide a hand grip exerciser which provides for the easy and rapid interchange between resistance elements of different elastic strengths and thus different force resistances to enable the same grip to be adjusted for the needs of individual users.

The need has therefore been recognized for an exercise hand grip which obviates the forgoing and other limitations and disadvantages of prior art hand grips. Despite the various hand grips in the prior art, there has heretofore not been provided a suitable and attractive solution to these problems.

DESCRIPTION OF THE PREFERRED EMBODIMENTS

Figure 1:
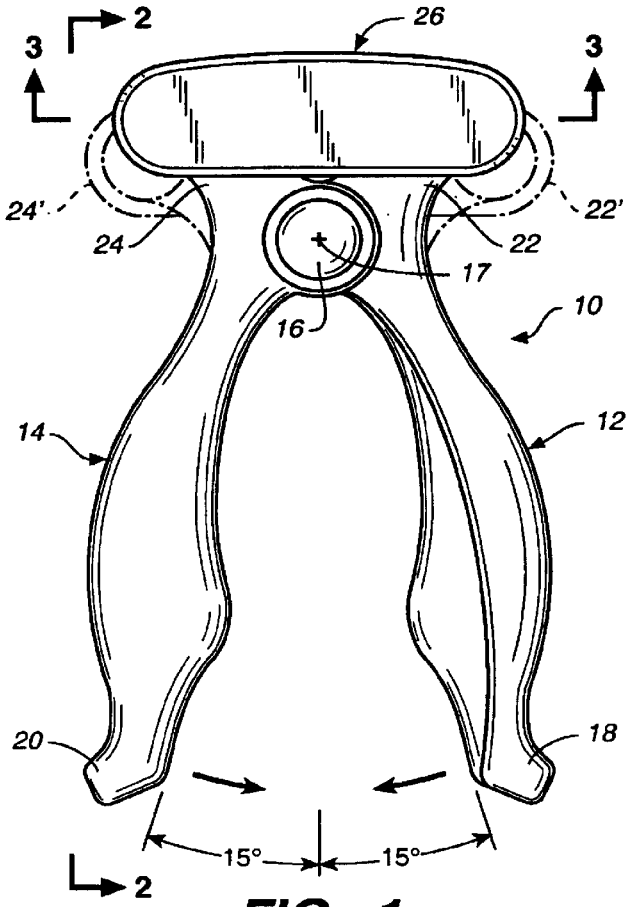
FIG. 1 is a front elevation view of a hand grip exerciser in accordance with one embodiment of the invention.
Figure 2:
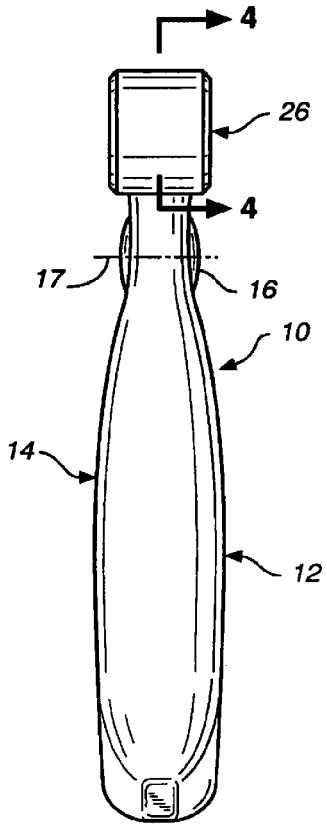
FIG. 2 is a side elevation view taken along the line 2—2 of FIG. 1.
Figure 3:
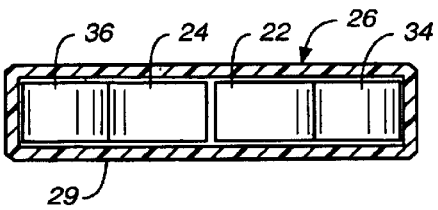
FIG. 3 is a horizontal cross-section view taken along the line 3—3 of FIG. 1.

FIG. 1 in the drawings show generally at 10 a hand grip exerciser in accordance with one embodiment. The exerciser 10 is comprised of a pair of opposed pivot elements 12 and 14. A pin 16 mounts the elements together for back-and-forth pivotal movement about an axis 17 which lies between the handles and head ends.

The elements 12 and 14 have respective handles 18 and 20 at the lower ends as well as respective head ends 22 and 24.

Preferably the handle 18 is of a suitably curved shape providing a comfortable fit with the palm of a user's hand, while the opposite handle 20 is suitably shaped for a conforming fit with the user's fingers when they are wrapped around the grip.

The head ends 22 and 24 pivot apart about pin 16 when the handles are gripped and squeezed toward each other against the yieldable resistance of force resistance member 26. When the user's grip is relaxed, the head ends pivot toward each other and the handles move apart due to the elastic restoring force of the resistance member. Preferably each handle pivots through a maximum arc on the order of 15° so that the total angular range of travel is 30° as shown in FIG. 1. The maximum outward positions of the head ends when the handles are fully squeezed together are represented by the phantom depictions 22' and 24'.

Force resistance member 26 is releasably mounted on the grip head ends 22 and 24. The resistance member is comprised of a hollow shell 28 having a wall 29 that is formed of a suitable elastomeric material, such as rubber or a stretchable synthetic polymer. The durometer hardness of the elastomeric material is a measure of the material's strength resistance to the stretching forces when the grip is squeezed. A plurality of the force resistance members having a durometer hardness of different values would be provided to the user with each grip, thus enabling interchange of the members in accordance the desired degree of resistance. For this purpose the durometer hardness can be in the range of 70 A to 85 A.

Figure 4:
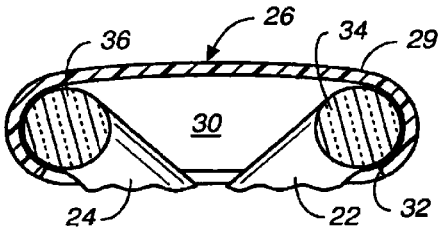
FIG. 4 is a vertical cross-section view taken along the line 4—4 of FIG. 2.
Figure 5:
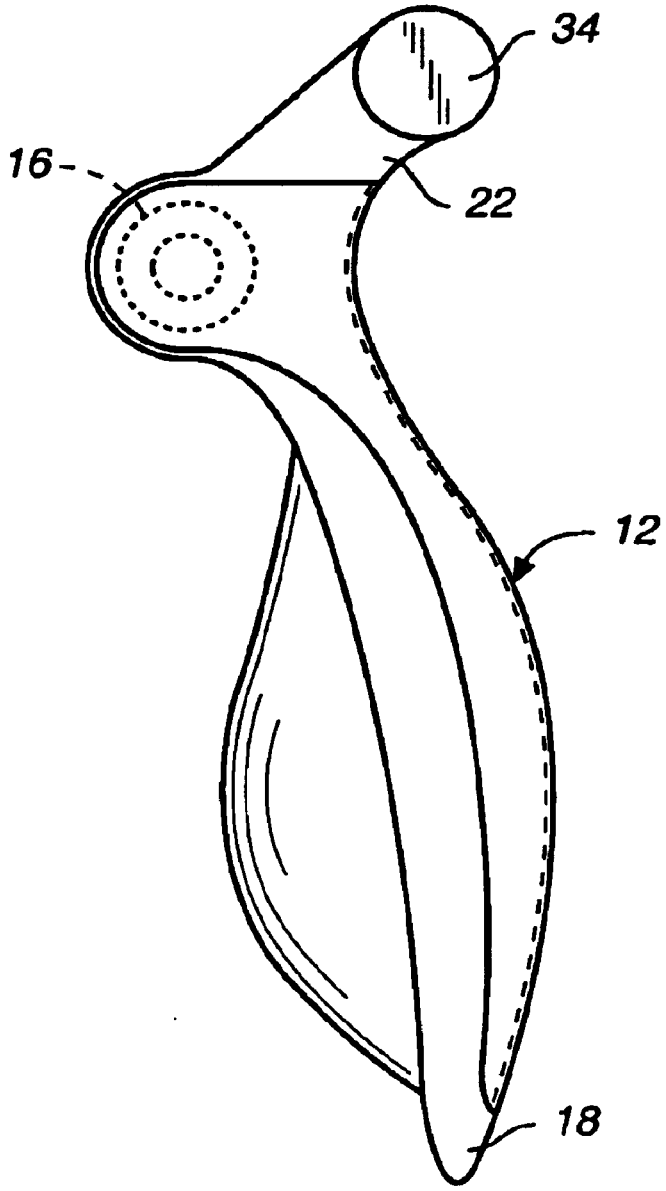
FIG. 5 is a front elevation view of a pivot element which is a component part of the hand grip exerciser of FIG. 1.

Easy and rapid interchange between the force resistance members is enabled by the hollow shell construction in which wall 29 forms an interior cavity 30 that opens below through an opening, shown as an elongate slot 32 as best shown in FIG. 4. Also as shown in that figure, the grip head ends are shaped in the form of round lateral cylinders 34 and 36 which fit within and are encaptured by cavity 30. The opposite ends of resistance member 26 wrap around these cylinders, with slot 32 being sufficiently wide and long to provide free clearance for the back and forth pivotal movement of the grip head ends. The size and elongate shape of slot 32 is further sufficient to enable ingress and egress of the head ends into and from cavity 30. The durometer hardness of member 26 is further selected so that its elasticity enables the slot to be stretched by the user sufficient for the head ends to inserted into and removed from the interior cavity. The head ends are releasably held when fitted inside the cavity due to the member's elastic restoring force, also termed elastic memory, that causes the slot to shrink back from its stretched shape when the stretching force is removed.

In operation, the user grasps his or her hand around the grip handles and repetitively squeezes together and releases the handles. Each gripping action causes the head ends to move apart against the yieldable resistance of force resistance member 26. When the gripping force is released the member's elastic memory causes the elements to pivot back.

When the user desires to interchange member 26 with another of either a stronger or weaker force resistance, then the yieldable expansion of slot 32 in the elastomeric member enables the easy and rapid withdrawal of the head ends from cavity slot 32. Next, the head ends of a replacement resistance member with the desired strength are inserted through the slot, enabling immediate resumption of use of the grip for exercise. This enables the user to rapidly customize the grip for a wide range of force resistances in accordance with the user's desired exercise regimen.

What is claimed is:

1. A hand grip for use in exercise by a person, the grip comprising, the combination of a pair of pivot elements, each pivot element having a handle and a head end, the elements being mounted for back-and-forth pivotal movement about an axis which is located between the handles and head ends and in which the head ends move apart when the handles are squeezed together, a force resistant member comprising a deformable wall the wall having an opening which is sized and shaped sufficient to enable the opening to deform for allowing ingress and egress of the head ends through the opening into and from the cavity, the opening having a width which is sufficient to enable back and forth movement of the pivot elements when the person alternatively squeezes the handles together, and the wall having an interior cavity which is sized and shaped sufficient to releasably encapture the head ends, and in which the wall deforms by expanding and applying a resistance force against the head ends as the head ends move apart.

2. A glove as in claim 1 and further characterized in that the opening comprises an elongated slot.

3. A glove as in claim 1 and further characterized in that the head ends are shaped in the form of cylinders, and the wall of the force resistant member has opposite ends which partially wrap around the cylinders.

4. A glove as in claim 1 and further characterized in that the wall is comprised of an elastomeric material.

5. A glove as in claim 1 and further characterized in that the elastomeric material has a durometer hardness in the range of 70A to 85A.

* * * * *